US008262757B2

(12) United States Patent
You

(10) Patent No.: US 8,262,757 B2
(45) Date of Patent: Sep. 11, 2012

(54) INFRARED CURED ABRASIVE ARTICLES

(75) Inventor: Xiaorong You, Shrewsbury, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 11/732,514

(22) Filed: Apr. 3, 2007

(65) Prior Publication Data

US 2007/0240365 A1 Oct. 18, 2007

Related U.S. Application Data

(60) Provisional application No. 60/874,311, filed on Dec. 12, 2006, provisional application No. 60/788,902, filed on Apr. 4, 2006.

(51) Int. Cl.

| | |
|---|---|
| ***B24D 3/02*** | (2006.01) |
| ***B24D 3/20*** | (2006.01) |
| ***B24D 3/28*** | (2006.01) |
| ***B24D 3/34*** | (2006.01) |
| ***B24B 1/00*** | (2006.01) |

(52) U.S. Cl. ..... 51/293; 51/295; 51/298; 451/28; 451/548; 427/508; 427/517

(58) Field of Classification Search ..... 51/295, 51/297, 298, 307–309; 451/28, 526, 539, 451/540; 427/487, 508, 513, 516, 517, 521, 427/553, 557, 559; 522/6–70

See application file for complete search history.

(56) References Cited

U.S. PATENT DOCUMENTS

| | | | | |
|---|---|---|---|---|
| 4,038,046 | A | 7/1977 | Supkis et al. | |
| 4,735,632 | A * | 4/1988 | Oxman et al. | 51/295 |
| 4,773,920 | A | 9/1988 | Chasman et al. | |
| 4,961,960 | A | 10/1990 | Iimure | |
| 5,047,556 | A | 9/1991 | Köhler et al. | |
| 5,108,463 | A | 4/1992 | Buchanan et al. | |
| 5,137,542 | A | 8/1992 | Buchanan et al. | |
| 5,152,917 | A * | 10/1992 | Pieper et al. | 51/295 |
| 5,328,716 | A | 7/1994 | Buchanan | |
| 5,417,726 | A | 5/1995 | Stout et al. | |
| 5,505,747 | A | 4/1996 | Chesley et al. | |
| 5,560,753 | A | 10/1996 | Schnabel et al. | |
| 5,565,011 | A | 10/1996 | Follett et al. | |
| 5,573,619 | A | 11/1996 | Benedict et al. | |
| 5,667,541 | A * | 9/1997 | Klun et al. | 51/298 |
| 5,686,639 | A | 11/1997 | Cohen | |
| 5,700,302 | A | 12/1997 | Stoetzel et al. | |
| 5,738,696 | A | 4/1998 | Wu | |
| 5,738,697 | A | 4/1998 | Wu et al. | |
| 5,766,277 | A | 6/1998 | DeVoe et al. | |
| 5,840,088 | A | 11/1998 | Yang et al. | |
| 6,048,375 | A | 4/2000 | Yang et al. | |
| 6,602,975 | B2 | 8/2003 | Hubbell et al. | |
| 6,679,758 | B2 | 1/2004 | Bright et al. | |
| 6,692,611 | B2 | 2/2004 | Oxman et al. | |
| 6,872,688 | B2 | 3/2005 | Suzuki | |
| 6,914,095 | B2 | 7/2005 | Lorah et al. | |
| 6,949,289 | B1 | 9/2005 | Lawton et al. | |
| 6,977,274 | B2 | 12/2005 | Lee et al. | |
| 2001/0053498 | A1 * | 12/2001 | Fujimoto et al. | 430/273.1 |
| 2002/0077037 | A1 * | 6/2002 | Tietz | 451/41 |
| 2003/0192258 | A1 | 10/2003 | Simon | |
| 2004/0023136 | A1 * | 2/2004 | Munnelly et al. | 430/18 |
| 2004/0062939 | A1 * | 4/2004 | Shimada et al. | 428/474.4 |
| 2005/0016672 | A1 | 1/2005 | Kim et al. | |
| 2005/0152652 | A1 | 7/2005 | Ohishi | |
| 2006/0194038 | A1 | 8/2006 | You et al. | |
| 2006/0207187 | A1 | 9/2006 | Gaeta et al. | |

FOREIGN PATENT DOCUMENTS

| | | |
|---|---|---|
| GB | 1 383 003 | 2/1975 |
| JP | 59 121045 | 7/1984 |
| JP | 63 205254 | 8/1988 |
| JP | 2002 030105 | 1/2002 |
| WO | WO 99/56913 | 11/1999 |
| WO | WO 01/74537 A1 | 10/2001 |
| WO | WO 03/057411 A1 | 7/2003 |

OTHER PUBLICATIONS

Kung, T., "Development of a Cross-Linked Imaging Layer for Thermal Dye Transfer Receiver," [Abstract], *The Society for Imaging Science & Technology, NIP20: International Conference on Digital Printing Technologies*, Salt Lake City, Utah (Oct./Nov. 2004).

PCT/US2007/008094: International Search Report dated Oct. 11, 2007.

PCT/US2007/008094: International Preliminary Report on Patentability dated Oct. 8, 2008.

PCT/US2007/008094: Written Opinion of the International Searching Authority dated Oct. 11, 2007.

Taiwanese Patent Application No. 096111811: Search Report dated Oct. 15, 2009.

* cited by examiner

*Primary Examiner* — Roy King
*Assistant Examiner* — Jared Wood
(74) *Attorney, Agent, or Firm* — Abel Law Group, LLP; Joseph P. Sullivan

(57) ABSTRACT

An abrasive article includes a polymer binder, an infrared radiation absorbing dye, and abrasive grains. In particular embodiments, the abrasive articles have been at least partially cured using infrared radiation. The abrasive articles of the present invention can include, for example, coated abrasives, structured abrasives, and bonded abrasives. Methods for manufacturing abrasive articles include at least partially curing an article that includes a polymer binder precursor, an infrared radiation absorbing dye, and abrasive grains using infrared radiation.

21 Claims, No Drawings

INFRARED CURED ABRASIVE ARTICLES

RELATED APPLICATIONS

This application claims the benefit of U.S. Provisional Application No. 60/874,311, filed on Dec. 12, 2006 and U.S. Provisional Application No. 60/788,902, filed on Apr. 4, 2006.

The entire teachings of the above applications are incorporated herein by reference.

BACKGROUND OF THE INVENTION

Abrasive articles generally include a binder material and abrasive grains. Typically, abrasive grains are held to the abrasive article using the binder. There are various classes of abrasive articles that are known in the art including, for example, coated abrasives, structured abrasives, and bonded abrasives. These types of abrasive articles are manufactured by various methods. One method of manufacture includes applying abrasive grains to an uncured or only partially cured binder and then curing the binder. Another method includes mixing abrasive grains with an uncured or only partially cured binder, forming the mixture into abrasive structures or spreading the mixture over a backing, and curing the binder.

Coated abrasives can include a backing, or substrate; a binder; and abrasive grains. Coated abrasive articles can be produced, for example, by coating a backing with a binder precursor, applying abrasive grains, and then curing the binder. Another method of manufacturing coated abrasives includes forming a mixture of binder and abrasive grains, applying the mixture onto a backing, and curing the binder. Some methods of producing coated abrasives include forming multiple layers of binder and/or abrasive grains. For example, a coated abrasive can include a compliant layer, a back coat; a make coat; a size coat; and/or a supersize coat.

Compliant layers and back coats generally refer to initial coatings that are applied to a backing. The compliant layer and/or back coat can be cured prior to application of other coats. A make coat is a layer of binder that has been applied over the backing. In some instances, abrasive grains are applied with the make coat, such as wherein the abrasive grains are blended with the binder prior to application to the backing. Alternatively, abrasive grains can be applied to the make coat after it has been placed over the backing. In the production of some coated abrasives, the make coat is then cured to anchor the abrasive grains in place.

Many coated abrasives also contain an additional binder layer. This layer, called a "size coat," is typically applied over abrasives grains to complete anchoring of the abrasive grains. In some instances, the size coat is then cured. Some coated abrasives also contain a third binder layer. This layer, called a "supersize coat," is typically applied over the size coat. The supersize coat can include materials such as, for example, an active filler, an anti-static material, an anti-loading material, or a grinding aid, to enhance the working properties of the abrasive article.

Structured, or engineered, abrasives generally include a backing and an abrasive layer in a pre-configured pattern. One method of forming a structured abrasive includes forming a mixture of abrasive grains and a binder precursor. The mixture is then applied onto a backing such that abrasive structures are formed on the backing. In some applications, the abrasive structures are cured after application of the structures to the backing. Other layers, including size and supersize coats, can be applied over the abrasive structures, with or without intermediate curing.

Bonded abrasives generally include abrasive grains fixed in a binder matrix. In one method of manufacture, a mixture including abrasive grains and a binder precursor is formed into an abrasive tool, for example, an abrasive disc or cylinder, and the tool is cured.

There are several known methods for curing binder precursors. These methods include using visible light, ultraviolet ("UV") radiation, electron beam radiation, conventional thermal treatment, and combinations thereof. In some instances, a conventional thermal treatment can be used following a primary curing method. For example, a binder precursor can be cured using UV radiation and then conventional thermal treatment can be used to post-cure the binder. Conventional thermal treatments include, for example, baking the binder precursor in ovens. In industrial manufacturing operations, post-curing by conventional thermal treatment can take as long as 4 to 20 hours in large ovens. Long periods of conventional thermal treatment are typically used to avoid thermal shock of the abrasive articles. As a result of long processing times, conventional thermal treatments can have a significant impact on the cost and efficiency of manufacturing abrasive articles. In addition, conventional ovens themselves are large, expensive, and radiate large amounts of heat into the manufacturing environment.

Conventional ovens heat abrasive articles from the outside to the inside and, in order to prevent thermal shock, long ramp-up times are required. This can cause the outer skin of the abrasives to cure and shrink first. Then, as the interior begins to heat up, it can expand and crack or stretch the outer skin. The interior can cure and shrink, creating a stress differential between the highly cross-linked outer skin and the interior region upon cooling. This can lead to deterioration of the binder's physical properties, e.g., elongation and toughness properties. Therefore, it can cause poor adhesion between the binder and abrasive grains, poor product life, and random deep scratches when the product is used.

For example, it is believed that conventional oven treatment can include the following mechanisms:

a. As the oven heats up, the outer skin of the film can be cured first;
b. Since the interior of the film can be less cured, uncured monomer can diffuse to the exterior skin and allow more cross-linking of the exterior skin as opposed to linear network cure;
c. As the interior region heats up, it can expand, thereby stretching and possibly cracking the exterior skin;
d. The interior region can cure and shrink, creating tension stresses in the interior and compression stresses in the outer skin. The interior region may achieve a lower cross-link density than the skin due to lower free monomer content;
e. Upon cooling, differing stresses and differing thermal contraction characteristics of the inner and outer matrices can lead to locked-in stresses or film distortions; and
f. Toughness can be diminished due to surface cracks and surface/interior stresses.

It is believed that these mechanisms can lead to significant deterioration of the abrasive article's working properties.

SUMMARY OF THE INVENTION

The present invention relates to abrasive articles which include a polymer binder, an infrared radiation ("IR") absorbing dye, and abrasive grains. In particular embodiments, the abrasive articles have been at least partially cured using infrared radiation. The abrasive articles of the present invention can include, for example, coated abrasives, structured abrasives, and bonded abrasives. The present invention also relates to methods for manufacturing abrasive articles which include at least partially curing an article that includes a polymer binder precursor, an infrared radiation absorbing dye, and abrasive grains using infrared radiation.

The present invention also includes a method for manufacturing an abrasive product that comprises providing an article that includes a polymer binder precursor, an infrared radiation absorbing dye, abrasive grains, and, optionally, a filler; selecting a source of infrared radiation based upon the infrared absorbance of at least one of the components selected from the group consisting of the polymer binder precursor, the infrared radiation absorbing dye, the abrasive grains, and the filler; and at least partially curing the article using the source of infrared radiation, thereby forming the abrasive product. For example, selecting a source of infrared radiation based upon the infrared absorbance of at least one of the components can include selecting a source of infrared radiation such that infrared radiation has a peak emittance that corresponds to an absorption band of at least one of the components. In other embodiments, the infrared radiation has a peak emittance that does not correspond to an absorption band of at least one of the components.

In other embodiments, a method for manufacturing an abrasive product can comprise selecting a source of infrared radiation; providing an article that includes a polymer binder precursor, an infrared radiation absorbing dye, abrasive grains, and, optionally, a filler; wherein at least one of the components selected from the group consisting of the polymer binder precursor, the infrared radiation absorbing dye, the abrasive grains, and the filler are selected for the article based upon infrared absorbance of the component; and at least partially curing the article using the source of infrared radiation, thereby forming the abrasive product. For example, at least one of the components can be selected for the article such that an absorption band of at least one of the components corresponds to a peak emittance of the infrared radiation. In other embodiments, an absorption band of at least one of the components does not correspond to a peak emittance of the infrared radiation.

The method for manufacturing abrasive products described herein has several advantages over conventional processes for preparing abrasive products. By practicing the methods of the present invention, abrasive articles can be manufactured that have relatively high deflection temperatures ("HDT") and glass transition temperatures ("Tg") without using conventional thermal curing methods. Abrasive articles having relatively high HDT and Tg are desirable. However, until the present invention, relatively high HDT and Tg were difficult to achieve without using a conventional thermal cure by, for example, baking the abrasive articles in an oven. By using an infrared radiation absorbing dye in conjunction with infrared radiation, the present methods can be used to cure a binder precursor or to post-cure a binder that has been previously cured with another method (e.g., using ultraviolet or electron beam radiation). The methods described herein can cure or post-cure binder materials and can achieve relatively high HDT and Tg in less time, using less energy, and in a safer manufacturing environment than conventional thermal processes.

The equipment needed to practice the present invention can also be simpler and less expensive to purchase and operate than ovens used for conventional thermal curing. For example, in some embodiments, simple infrared lamps can be used to supply infrared radiation.

The abrasive articles produced as described herein can have improved properties over conventionally manufactured abrasives. For example, the abrasive articles can avoid the previously described problems of conventional thermal treatment. By practicing the present invention, there can be lower, or even eliminated, differentials of cross-linking and stresses between the outer skin and the interior. The binder can heat, expand, cure, shrink, and thermally contract at substantially the same rates. This can lead to tougher abrasives.

By practicing the present invention, it is believed that the uniformity of temperature throughout the abrasive article can be controlled better than when a conventional thermal process is used. For example, the amounts, concentration, and location of the infrared radiation absorbing dye can be controlled to produce a desired temperature profile when the article is exposed to infrared radiation. This new ability to direct the application of curing energy is a vast improvement over conventional processes that heat only from the outside to the inside of the abrasive article.

In one embodiment, the amounts, concentration, and location of the infrared radiation absorbing dye can be controlled to produce a uniform temperature profile when the article is exposed to infrared radiation. Without being held to any particular theory, it is believed that this ability to direct the application of curing energy results in abrasive articles with improved properties. For example, the stock removal performance of the abrasive articles described herein can be significantly improved over abrasive articles manufactured using conventional processes. In addition, the abrasive articles can have tougher high temperature binder which can be particularly useful for high performance abrasives. In other embodiments, the amounts, concentration, and location of the infrared radiation absorbing dye can be controlled to produce targeted, localized temperature profiles when the article is exposed to infrared radiation. For example, a layer of IR absorbing dye can be used to focus curing energy at or near the dye layer. In some instances, such focused energy delivery can provide increased adhesion or bonding of neighboring regions of binder material and thereby increase performance of the abrasive article. In other instances, this focused energy delivery can provide increased adhesion or bonding of binder to abrasive grains or to backing materials and thereby increase performance of the abrasive article.

DETAILED DESCRIPTION OF THE INVENTION

A description of example embodiments of the invention follows.

Abrasive articles of the present invention include a polymer binder, an infrared radiation absorbing dye, and abrasive grains.

The term "polymer binder," as used herein, refers to a material that is capable of holding or anchoring abrasive grains. Polymer binders suitable for use in the present invention include any of the polymer binders known in the abrasive art including radiation cured resins, thermally cured resins, and mixtures thereof. Radiation cured resins include those cured using electron beam radiation, UV radiation or visible light, such as cured acrylated oligomers of acrylated epoxy resins, acrylated urethanes and polyester acrylates, acrylated monomers including monoacrylated, multiacrylated monomers, as well as cured mixtures of such resins. Thermally cured resins include cured phenolic resins, urea/formaldehyde resins and epoxy resins, as well as cured mixtures of such resins. Other suitable polymer binders include those cured through a thermal cure function and a radiation cure function that are provided by different functionalities of the same molecule.

In one embodiment, the polymer binder of the abrasive article includes at least one polymer selected from the group consisting of phenolic polymers, urethane polymers, epoxy polymers, acrylate polymers, epoxy/acrylate polymers, acrylated urethane polymers, acrylated epoxy polymers, and urea-formaldehyde polymers. For example, the polymer binder can include an epoxy/acrylate polymer.

The term "infrared radiation ("IR") absorbing dye," as used herein, refers to any substance that absorbs infrared radiation, for example, a substance that converts infrared radiation into heat energy. IR absorbing dyes particularly suitable for use in the present invention are those that absorb light energy in the IR spectrum such as those dyes that have at least one absorption band in the IR spectrum. For example, the IR absorbing dye can have an absorption band at a wavelength of about 0.7 to about 1000 microns, e.g., at about 0.7 to about 1000, about 0.7 to about 100, about 0.7 to about 50, about 0.7 to about 10, or about 0.7to about 1.3 microns. In some embodiments, the IR dye can have an absorption band at a wavelength of about 0.7 to about 1.3 microns, about 0.7 to about 5 microns, about 1.3 to about 3 microns, about 3 to about 8 microns, about 8 to about 15 microns, about 15 to about 50 microns, or about 50 to about 100 microns.

In general, the IR absorbing dye can be selected based on the absorption ratio of the dye and on particular IR wavelength(s) of interest. In one embodiment, the IR absorption of the IR absorbing dye is matched to a source of IR that has been used to at least partially cure a polymer binder precursor. For instance, the IR absorbing dye can have at least one absorption band within the IR spectrum and the source of IR has a peak intensity within the absorption band. Preferably, the IR absorbing dye is compatible with the polymer binder precursor.

IR absorbing dyes particularly suitable for use in the present invention are those that absorb light energy primarily at wavelengths in the IR spectrum such as those dyes that have a peak absorption within the IR spectrum. In some embodiments, the IR absorbing dye has little, or no, absorption in the UV portion and/or in the visible light portion of the electromagnetic spectrum.

In one embodiment, the IR absorbing dye has an absorption intensity at any wavelength in the non-infrared spectrum of less than about 75%, 50%, 25%, 15% or less than about 10% of its peak absorption intensity within the infrared spectrum. For example, in some embodiments, the IR absorbing dye has an absorption intensity at any wavelength in the non-infrared spectrum of less than about one-third its peak absorption intensity within the infrared spectrum.

Preferably, the IR absorbing dye has a large extinction coefficient in the IR spectrum. In one preferred embodiment, the IR absorbing dye has a large extinction coefficient in the near IR, e.g., radiation with a wavelength of about 0.7 to about 1.3 microns. In some embodiments, the dye has a large extinction coefficient at wavelengths of about 0.7 to about 10, about 0.7 to about 5, or about 0.7 to about 1.3 microns.

Examples of suitable IR absorbing dyes include, but are not limited to, metalated organic dyes such as cyanine dyes, squarylium dyes, croconium dyes, metal phthalocyanine dyes, metalated azo dyes, metalated indoaniline dyes, amminium dyes, metal complex dyes, and combinations thereof.

Examples of suitable IR absorbing dyes include near IR dyes such as those that are available from H.W. Sands Corp. (Jupiter, Fla.) including, but not limited to, SDB8303; SDA6766; SDB5700; SDA5701; SDA6075; SDA1248; SDA9530; SDA5177; SDA2826; SDA3922; SDA3598; SDA3903; SDA6825; SDA7460; SDA7127; SDA1155; SDA7590; SDA2009; SDA8470; SDB5491; SDB6906; SDA7257; SDA6017; SDB7611; SDA6995; SDD5712; SDA2435; SDA6390; SDA5400; SDA1372; SDA7999; SDB8662; SDA8030; SDA2864, SDA7950; SDA6533; SDA1971; SDA7454; SDA9393; SDA1037; SDA5725; SDA5303; SDB1217; SDA2441; SDA1816; SDA1842; SDA9158; SDA8520; SDA1971; SDA7847; SDA8058; SDG7047; SDA7591; SDA3984; SDA9349; SDA4530; SDA7563; SDA6722; SDA9362; SDA3943; SDA4927; SDA8208; SDA6104; SDA4301; SDA4639; SDA2046; SDA4554; SDA8703; SDA5688; SDA8700; SDA8435; SDA6370; SDA8690; SDA6958; SDA7400; SDA4659; SDA3610; SDA8630; SDA9018; SDA6122; SDA1868; SDA7670; SDA6567; SDA3313; SDA8851; SDA5484; SDA6036; SDA7335; SDA5575; SDA6211; SDA7780; SDA7481; SDA3629; SDA7779; SDA6939; SDA4850; SDA1910; SDA9454; SDA2086; SDA3235; SDA5893; SDA7202; SDA5677; SDA2870; SDA9510; SDA2635; SDA6248; SDA7760; SDA2072; SDA3958; SDA4137; SDA1981; SDA7559; SDA6442; SDA9800; SDA9811; SDA9932; SDA7816; SDA2126; SDA8402; SDA8272; SDA3581; SDA4428; SDA2643; SDA2966; SDA3535; SDA4663; SDA5142; SDA3396; SDA3011; SDA3734; SDB6592; SDA8080; SDA1065; SDA2266; SDA7630; SDA7684; SDA; SDA1072; and the like.

Other manufacturers of suitable IR dyes include, but are not limited to, Avecia, Inc. (Wilmington, Del.); Gentex Corporation (Simpson, Pa.); and Epolin, Inc. (Newark, N.J.), Liaoning Huahai-Lanfan Chemical Technology Co., Ltd.

The concentration of the IR absorbing dye in the article, or within individual binder layers of the article, can vary. In some embodiments, the dye is present at a concentration of about 0.0000001 weight percent (wt %) to about 10 wt % such as, for example, about 0.0001 wt % to about 10 wt %, about 0.0001 wt % to about 2 wt %, about 0.0001 wt % to about 1 wt %, about 0.0001 wt % to about 0.1 wt %, about 0.0001 wt % to about 0.01 wt %, or about 0.0001 wt % to about 0.001 wt % (all wt % based on weight of polymer binder). In some embodiments, the abrasive article contains IR absorbing dye wherein the concentration of the dye varies based on depth within the article. In some embodiments, the lower levels of the article contain a higher concentration of dye. In other embodiments, the concentration of the dye in the article varies based on the local composition of the abrasive article proximate to the dye. One of skill in the art would recognize how the concentration of dye can be varied to effectuate any desired local heating.

In some embodiments, the article contains at least two different IR absorbing dyes. In some instances, the concentration of at least one of the different IR absorbing dyes is uniform throughout the article. For example, the concentration of each of the different IR absorbing dyes can be uniform throughout the article. In other instances, at least one of the different IR absorbing dyes can be concentrated in a particular region of the article. For example, one of the different IR absorbing dyes can be concentrated in one region of the article and a second IR absorbing dye can be concentrated in a second region of the article. The concentration and distribution of the IR absorbing dyes can be manipulated to influence the heating profiles of the article and of regions of the article.

The abrasive grains can include of any one or a combination of grains, including, but not limited to, silica, alumina (fused or sintered), zirconia, zirconia/alumina oxides, silicon carbide, garnet, diamond, cubic boron nitride (CBN), silicon nitride, ceria, titanium dioxide, titanium diboride, boron carbide, tin oxide, tungsten carbide, titanium carbide, iron oxide, chromia, flint, and emery. For example, the abrasive grains may be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, and a blend thereof. In some instances, dense abrasive grains comprised principally of alpha-alumina and/or gamma alumina can be used.

The abrasive grains can also include abrasive agglomerate grains, also known as agglomerated abrasive grains. Abrasive agglomerate grains include abrasive particles adhered together by a particle binder material. The abrasive particles present in abrasive agglomerate grains can include one or more of the abrasives known for use in abrasive tools such as, for example, silica, alumina (fused or sintered), zirconia, zirconia/alumina oxides, silicon carbide, garnet, diamond, cubic boron nitride (CBN), silicon nitride, ceria, titanium dioxide, titanium diboride, boron carbide, tin oxide, tungsten carbide, titanium carbide, iron oxide, chromia, flint, emery, and combinations thereof. The abrasive particles can be of any size or shape. The abrasive agglomerate grains can be adhered together by a particle binder material such as, for example, a metallic, organic, or vitreous material, or a combination of such materials. Abrasive agglomerate grains suitable for use in the present invention are further described in U.S. Pat. No. 6,797,023, issued on Sep. 28, 2004, to Knapp, et al., the entire contents of which is incorporated herein by reference.

The abrasive grains can have one or more particular shapes. Example of such particular shapes include rods, triangles, pyramids, cones, solid spheres, hollow spheres and the like. Alternatively, the abrasive grains can be randomly shaped.

Typically, the abrasive grains have an average grain size not greater than 2000 microns such as, for example, not greater than about 1500 microns. In another example, the abrasive grain size is not greater than about 750 microns, such as not greater than about 350 microns. In some embodiments, the abrasive grain size may be at least 0.1 microns, such as from about 0.1 microns to about 1500 microns, and, more typically, from about 0.1 microns to about 200 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled.

In some abrasive articles, the abrasive grains can be present at a concentration of about 5 wt % to about 95 wt % such as, for example, about 10 wt % to about 90 wt %, about 15 wt % to about 85 wt %, about 30 wt % to about 80 wt %, or about 25 wt % to about 75 wt % (all wt % based upon the weight of the abrasive article).

In some embodiments, the abrasive grains are IR absorbers. For example, IR absorbing abrasive grains can be selected to effect localized heating at or near the abrasive grains when an article is exposed to IR. In other embodiments, abrasive grains can be selected to minimize localized heating at or near the abrasive grains when an article is exposed to IR.

The abrasive articles can include a backing. For example, the polymer binder, the IR absorbing dye, and the abrasive grains are disposed over a backing. The backing can be flexible or rigid. The backing can be made of any number of various materials including those conventionally used as backings in the manufacture of coated abrasives. In some embodiments, the backing is at least partially transparent to IR. In other embodiments, the backing is an IR absorber. For example, a backing that is an IR absorber can be selected to effect localized heating at or near the backing when the article is exposed to IR.

Suitable backings can include polymeric films (for example, a primed film), such as polyolefin films (e.g., polypropylene including biaxially oriented polypropylene), polyester films (e.g., polyethylene terephthalate), polyamide films, or cellulose ester films; metal foils; meshes; foams (e.g., natural sponge material or polyurethane foam); cloth (e.g., woven, non-woven, fleeced, stitch bonded, or quilted, or cloth made from fibers or yams comprising polyester, nylon, silk, cotton, poly-cotton or rayon); paper; vulcanized paper; vulcanized rubber; vulcanized fiber; nonwoven materials; a treated backing thereof; or any combination thereof.

The backing can have at least one of a saturant, a presize layer or a backsize layer. The purpose of these layers is typically to seal the backing or to protect yarn or fibers in the backing. If the backing is a cloth material, at least one of these layers is typically used. The addition of the presize layer or backsize layer may additionally result in a "smoother" surface on either the front or the back side of the backing. Other optional layers known in the art can also be used (for example, a tie layer; see U.S. Pat. No. 5,700,302 (Stoetzel, et al.), the entire contents of which are incorporated herein by reference).

In some embodiments, the abrasive articles are intended for use as fine grinding materials and hence a very smooth surface can be preferred. Examples of such smooth surfaced backings include finely calendered papers, plastic films or fabrics with smooth surface coatings.

The backing can have antistatic properties. The addition of an antistatic material can reduce the tendency of the abrasive article to accumulate static electricity when sanding wood or wood-like materials. Additional details regarding antistatic backings and backing treatments can be found in, for example, U.S. Pat. Nos. 5,108,463 (Buchanan, et al.); 5,137,542 (Buchanan, et al.); 5,328,716 (Buchanan); and 5,560,753 (Buchanan, et al.), the entire contents of which are incorporated herein by reference.

The backing can include a fibrous reinforced thermoplastic such as described, for example, in U.S. Pat. No. 5,417,726 (Stout, et al.), or an endless spliceless belt, as described, for example, in U.S. Pat. No. 5,573,619 (Benedict, et al.), the entire contents of which are incorporated herein by reference. Likewise, the backing can include a polymeric substrate having hooking stems projecting therefrom such as that described, for example, in U.S. Pat. No. 5,505,747 (Chesley, et al.), the entire contents of which is incorporated herein by reference. Similarly, the backing can include a loop fabric such as that described, for example, in U.S. Pat. No. 5,565,011 (Follett, et al.), the entire contents of which is incorporated herein by reference.

The abrasive articles of the present invention can also include various other components. For example, the abrasive articles can include photoinitiators, non-reactive thermoplastic resins; fillers, grinding aids; and other additives. In some embodiments, at least some of these additional components are at least partially transparent to IR or do not substantially interfere with the transmission of IR. For example, in one embodiment, the abrasive article contains a filler that is at least partially transparent to IR. In other embodiments, at least some of these additional components can be IR absorbers. For example, a filler that is an IR absorber can be selected to effect localized heating at or near the filler when the article is exposed to IR.

In some embodiments, the abrasive article includes a photoinitiator which generates free radicals when exposed to radiation, e.g., UV radiation. Free-radical generators can include organic peroxides, azo compounds, quinones, benzophenones, nitroso compounds, acryl halides, hydrozones, mercapto compounds, pyrylium compounds, triacrylimidazoles, bisimidazoles, chloroalkyltriazines, benzoin ethers, benzil ketals, thioxanthones and acetophenones, including derivatives of such compounds. Among these the most commonly employed photoinitiators are the benzil ketals such as 2,2-dimethoxy-2-phenyl acetophenone (available from Ciba Specialty Chemicals under the trademark IRGACURE® 651) and acetophenone derivatives such as 2,2-diethoxyacetophenone ("DEAP", which is commercially available from First Chemical Corporation), 2-hydroxy-2-methyl-1-phenylpropan-1-one ("HMPP", which is commercially available from Ciba Specialty Chemicals under the trademark DAROCUR® 1173), 2-benzyl-2-N,N-dimethylamino-1-(4-morpholinophenyl)-1-butanone, (which is commercially available from Ciba Specialty Chemicals under the trademark IRGACURE® 369); and 2-methyl-1-(4-(methylthio)phenyl)-2-morpholinopropan-1-one, (available from Ciba Specialty Chemicals under the trademark IRGACURE® 907).

The abrasive articles can include a non-reactive thermoplastic resin such as, for example, polypropylene glycol, polyethylene glycol, and polyoxypropylene-polyoxyethene block copolymer.

The abrasive articles can include a filler. Fillers include organic fillers, inorganic fillers, and nano-fillers. Examples of suitable fillers include, but are not limited to, metal carbonates such as calcium carbonate and sodium carbonate; silicas such as quartz, glass beads, glass bubbles; silicates such as talc, clays, calcium metasilicate; metal sulfate such as barium sulfate, calcium sulfate, aluminum sulfate; metal oxides such as calcium oxide, aluminum oxide; aluminum trihydrate, and combinations thereof.

The abrasive articles can include a grinding aid to increase the grinding efficiency and cut rate. Useful grinding aids can be inorganic, such as halide salts, e.g., sodium cryolite and potassium tetrafluoroborate; or organic based, such as chlorinated waxes, e.g., polyvinyl chloride. In one particular embodiment, the abrasive article includes cryolite and potassium tetrafluoroborate with particle size ranging from about 1 micron to about 80 microns, most typically from about 5 microns to about 30 microns. The concentration of grinding aid in a make coat is generally not greater than about 50 wt %, for example, the concentration of grinding aid is often about 0.1 wt % to 50 wt %, and most typically about 10 wt % to 30 wt % (all wt % based on make coat weight including abrasive grains).

Examples of additional additives include coupling agents, such as silane coupling agents, e.g., A-174 and A-1100 available from Osi Specialties, Inc., titanate, and zircoalurminates; anti-static agents, such as graphite, carbon black, and the like; suspending agent, such as fumed silica, e.g., Cab-O-Sil M5, Aerosil 200; anti-loading agents such as zinc stearate and calcium stearate; lubricants such as wax, PTFE powder, polyethylene glycol, polypropylene glycol, and polysiloxanes; wetting agents; pigments; dispersants; and defoamers.

The abrasive articles of the present invention include, for example, coated abrasives, structured abrasives, and bonded abrasives. In some embodiments, the abrasive articles contain compliant layers; back coats; make coats; size coats; and/or supersize coats. The IR absorbing dye can be present in one or more of these layers. For example, in one embodiment, a make coat includes at least a portion of the infrared radiation absorbing dye and at least a portion of the polymer binder. In another embodiment, a size coat includes at least a portion of the infrared radiation absorbing dye and at least a portion of the polymer binder.

In one embodiment, the abrasive article is a coated abrasive. A coated abrasive includes at least one of the following layers: a complaint layer, a back coat, a make coat, a size, and a supersize coat. One or more of these layers can include the polymer binder and the IR absorbing dye. For example, both a make coat and a size coat can include the polymer binder and the IR absorbing dye. In another embodiment, only the make coat or the size coat includes the polymer binder and the IR absorbing dye.

The abrasive articles of the present invention have been at least partially cured using infrared radiation. In some instances, the abrasive articles have also been cured using another method of curing, for example, curing by UV radiation, electron beam radiation, or conventional thermal curing. In one particular embodiment, the abrasive article has been at least partially cured using UV radiation and has been subsequently cured using IR.

In some of the abrasive articles, at least one of a complaint layer, a back coat, a make coat, a size, and a supersize coat includes an IR absorbing dye and has been at least partially cured using IR. For example, in some embodiments, a make coat and/or a size coat contains an IR absorbing dye and has been partially cured using UV radiation and partially cured using IR.

The present invention also relates to methods for manufacturing abrasive articles which include at least partially curing an article that includes a polymer binder precursor, an infrared radiation absorbing dye, and abrasive grains using infrared radiation.

The polymer binder precursor can include monomers, polymers, copolymers, and oligomers of the polymer binders described supra. In addition, the polymer binder precursor can include photoinitiators, non-reactive thermoplastic resins, fillers, grinding aids, and other additives (also described supra), as well as, in some instances, one or more solvents or suspension agents such as, e.g., water and organic solvents.

In one embodiment, the IR absorbing dye can be combined with the polymer binder precursor and the abrasive grains are applied to the resulting mixture, for example, using gravity deposition or upward projection ("UP") deposition of grain. Alternatively, the IR absorbing dye, the polymer binder precursor, and the abrasive grains are combined and used to form the article. In both cases, the resulting mixture is eventually at least partially cured using IR.

In other embodiments, the IR absorbing dye can be combined with the polymer binder precursor and the resulting mixture can be applied to an article that will contain abrasive grains or that already contains abrasive grains, e.g., as a compliant, back, make, size, or supersize coat. The resulting article is eventually at least partially cured using IR.

Generally, the article which includes the polymer binder precursor, the IR absorbing dye, and the abrasive grains is formed and exposed to infrared radiation. Any of the methods known in the art for forming articles having a polymer binder and abrasive grains can be used. For example, in one embodiment, a coated article is formed and is eventually at least partially cured using IR. Coated articles can include various layers such as make, size, and super size coats disposed over a backing material. One or more of such layers can include at least a portion of the IR absorbing dye and at least a portion of the polymer binder precursor. Various suitable techniques for forming coated articles which have a polymer binder precursor and abrasive grains are well-known in the art.

In some embodiments, the article is formed by any of those techniques known in the art in which abrasive structures are shaped prior to curing. Such techniques include, for example, embossing techniques. According to the present invention, for instance, a mixture of polymer binder precursor, IR absorbing dye, and abrasive grains can be contacted with a backing and a production tool such that the mixture is adhered to one surface of the backing. Abrasive structures are thus formed that have the shape of an inside surface of the production tool. Other suitable techniques for forming abrasive structures include including rotogravure coating.

In another embodiment, an article is formed by preparing an agglomerate that includes the polymer binder precursor, the IR absorbing dye, and the abrasive grains. The agglomerate is then shaped using any of the techniques known in the art for preparing a bonded abrasive. These shaping techniques may be carried out before, during or after exposure of the article to IR. Suitable techniques for preparing bonded abrasives are further described in, for example, U.S. Pat. Nos. 5,738,696 (Wu), 5,738,697 (Wu, et al.), and 6,679,758 (Bright, et al.), and U.S. Patent Publication No. 2003/0192258 A1 (Simon), the entire contents of each of which are incorporated herein by reference.

Methods for manufacturing abrasive articles can include the step of forming an article from the polymer binder precursor, the infrared radiation absorbing dye, and the abrasive grains. In some embodiments, the methods comprise the step of selecting, based on infrared absorbance of the component, at least one of the article components selected from the group consisting of the polymer binder precursor, the infrared radiation absorbing dye, and the abrasive grains. In some instances, the methods can comprise the step of forming the article from the polymer binder precursor, the infrared radiation absorbing dye, the abrasive grains, a backing material, and a filler. The components of the article can be selected based on infrared absorbance of a component and the degree of infrared absorbance that is desired. For example, in some embodiments it can be preferable that some components absorb relatively large amounts of infrared radiation. In other embodiments, it can be preferable that some components absorb relatively small amounts of infrared radiation. In other embodiments, it can be preferable that some components absorb almost no infrared radiation.

The components of the article can be selected to provide the desired infrared absorption. For example, in one embodiment, a method for manufacturing abrasive articles includes the step of selecting, based on infrared absorbance of the component, at least one of the article components selected from the group consisting of the polymer binder precursor, the infrared radiation absorbing dye, the abrasive grains, the backing material, and the filler. In another embodiment, a method for manufacturing abrasive articles includes the step of selecting, based on the temperature change of various articles over time when exposed to the infrared radiation, at least one of the article components selected from the group consisting of the polymer binder precursor, the infrared radiation absorbing dye, the abrasive grains, the backing material, and the filler.

Infrared radiation can be supplied by any source of IR. The infrared radiation can be coherent or non-coherent radiation. Sources of IR include IR lasers and incandescent lamps. In one embodiment, IR can be supplied by a lamp using an IR bulb, e.g., an incandescent lamp. Examples of suitable IR light bulbs include BBA light bulbs including, but not limited to, 250 W BBA light bulbs having a color temperature of 3400K (General Electric Lighting; Cleveland, Ohio) and bulbs made by Phillips Electronics Corp. (New York, N.Y.) such as Part No. PF-207E and Osram Sylvania (Danvers, Mass.) such as Part No. 11619.

Generally, IR absorbing dyes convert light energy to phonon energy and generate heat. IR absorbing dyes can be tailored to have absorption bands at various wavelengths and many such dyes are commercially available such as, for example, the dyes available from H.W. Sands, Inc. listed supra. Preferably, the IR source has a peak IR radiant emittance at a wavelength that corresponds to an absorption band of the IR absorbing dye. In some embodiments, the IR absorbing dye can have an absorption band at a wavelength of about 0.7 to about 1000 microns, e.g., at about 0.7 to about 1000, about 0.7 to about 100, about 0.7 to about 50, about 0.7 to about 10, or about 0.7 to about 1.3 microns and the IR source has a peak radiant emittance within the same wavelength range. For example, if the peak output of an IR source is at about 0.85 microns, the IR absorbing dye can be chosen to have an absorption band at or near 0.85 microns.

Preferably, the majority of the energy absorbed by the IR dye is infrared radiation provided by the IR source. In some instances at least about 95% of electromagnetic radiation absorbed by the dye is infrared radiation. In other instances at least about 90%, 85%, 80%, 75%, 70%, 65%, 60%, 55%, or at least about 50% of electromagnetic radiation absorbed by the dye is infrared radiation from the IR source.

In some circumstances, an array of IR emitting lamps can be used to cure the article which includes a polymer binder precursor, an infrared radiation absorbing dye, and abrasive grains. For example, the article can include a "jumbo," or roll, of coated abrasive and an array of IR emitting lamps is used to supply IR as a sheet of coated abrasive is passed near the array to cure the coated abrasive.

In some instances, the infrared radiation can be supplied by multiple IR sources having various IR emittances. Multiple IR sources having various IR emittances can be selected to correspond to the IR absorption of article components that absorb IR at various wavelengths. For example, one IR source can be selected to correspond to the IR absorption of the IR absorbing dye and a second IR source can be selected to correspond to the IR absorption of an IR absorbing polymer binder, abrasive grain, filler, or backing material. As a second example, one IR source can be selected to correspond to the IR absorption of a first IR absorbing dye and a second IR source can be selected to correspond to the IR absorption of a second IR absorbing dye. In other instances, multiple IR sources having various IR emittances can be selected to correspond to the IR absorption of a single article component that absorbs IR at various wavelengths. For example, multiple IR sources having various IR emittances can be selected to correspond to a single IR absorbing dye that absorbs IR at various wavelengths.

The article can be at least partially cured using any method such as, for example, using ultraviolet radiation or conventional thermal curing before or following at least partial curing using IR. In one instance, the polymer binder precursor includes an ultraviolet radiation curable binder precursor and the method further includes the step of at least partially curing the ultraviolet radiation curable binder precursor using ultraviolet radiation. For example, the article can be at least partially cured using UV radiation or using IR, either sequentially or simultaneously. An IR source in-line with a UV radiation source can be used to sequentially UV cure and IR cure abrasive articles. An IR source can also be paired with a UV source to cause both types of curing to occur simultaneously.

As described supra, the present invention includes methods for manufacturing abrasive articles which include at least partially curing an article that includes a polymer binder precursor, an infrared radiation absorbing dye, and abrasive grains using infrared radiation. In one aspect of the invention, the method can further include the step of selecting infrared radiation based upon the infrared absorbance of at least one of the components selected from the group consisting of the polymer binder precursor, the infrared radiation absorbing dye, and the abrasive grains. In some embodiments, the infrared radiation is selected based upon the infrared absorbance of the infrared radiation absorbing dye and also based upon the infrared absorbance at least one of the components selected from the group consisting of the polymer binder precursor and the abrasive grains.

In one aspect, the method for manufacturing an abrasive article includes the step of selecting the source of infrared radiation based upon the infrared absorbance of the article. A method for manufacturing abrasive articles can also include the step of selecting the source of infrared radiation based upon the change in temperature of the article over time when the article is exposed to various sources of infrared radiation.

The present invention also includes methods for manufacturing abrasive articles which include at least partially curing an article that includes a polymer binder precursor, an infrared radiation absorbing dye, abrasive grains, and a backing material and/or a filler, using infrared radiation. In one aspect of the invention, the method can further include the step of selecting infrared radiation based upon the infrared absorbance of at least one of the components selected from the group consisting of the polymer binder precursor, the infrared radiation absorbing dye, the abrasive grains, the backing material, and the filler. In some embodiments, the infrared radiation is selected based upon the infrared absorbance of the infrared radiation absorbing dye and also based upon the infrared absorbance at least one of the components selected from the group consisting of the polymer binder precursor, the abrasive grains, the filler, and the backing material.

In one embodiment, a polymer binder precursor, an infrared radiation absorbing dye, and abrasive grains are applied over a backing material. The resulting article is then at least partially cured using UV radiation. Then, the article is at least partially cured using IR. In another embodiment, a polymer binder precursor; abrasive grains; and, optionally, an infrared radiation absorbing dye are applied over a backing material. The resulting article is then at least partially cured using UV radiation. Then, a size coat containing an IR absorbing dye and a polymer binder precursor is applied to the article, the article is UV cured, and then the article is IR cured.

In the case of articles that are at least partially UV cured, it can be desirable to choose IR absorbing dyes that have little, or no, absorption in the UV and/or in the visible spectrum and a large extinction coefficient in the IR spectrum, e.g., the near IR.

The invention also includes the method of manufacturing an abrasive product described herein wherein the polymer binder precursor includes a thermally curable polymer binder precursor and the method further includes the step of at least partially curing the polymer binder precursor in an oven, e.g., a conventional thermal oven. Such an oven cure can be performed either before, after, or during exposure to IR.

In some instances, the article is formed such that the IR absorbing dye is distributed throughout at least a portion of the polymer binder precursor, e.g., by mixing the IR absorbing dye and the polymer binder precursor. In other instances, the article is formed such that it contains a distinct layer of the IR absorbing dye, e.g., by alternating applying layers of polymer binder precursor and dye. In yet other instances, the article is formed such that it contains local concentrations or pockets of the IR absorbing dye.

The concentration of the IR absorbing dye in the article, or in individual binder precursor layers of the article, can vary to affect desired curing of the binder precursor. Preferably, the concentration of the IR absorbing dye in the article, or in individual layers of the article, is chosen such that, for a given film thickness, the energy from the IR is substantially uniformly absorbed (e.g., the film is heated uniformly through its thickness). In one embodiment, varying concentrations of IR absorbing dye are applied with polymer binder precursor in thin layers. For example, a make coat and/or size coat can be applied to a backing material by applying a plurality of thin layers of polymer binder precursor and IR absorbing dye. The concentration of the IR absorbing dye can vary in the thin layers with the depth of the thin layers in the coat.

In some embodiments, the article contains IR absorbing dye wherein the concentration of the dye varies based on the distance of the dye from the IR source. For example, in some embodiments, the lower levels of the article contain a higher concentration of dye. In addition, the dye concentration in individual layers, e.g., a make coat or a size coat, can increase as distance from the IR source increases. By varying the concentration of dye, the uniformity of the temperature profile can be managed.

In another embodiment, the article contains IR absorbing dye wherein the concentration of the dye in the article varies based on the local composition of the article proximate to the dye. For instance, if the article has a composition that interferes with initial curing (e.g., via UV radiation), a high dye concentration can be desirable to effect a suitable post-cure via IR. Alternatively, a lower concentration of dye can be used wherein a mostly complete initial cure is expected and local heating requirements are lower during a post-cure.

The method can include the step of applying the polymer binder precursor, the dye, and the abrasive grains over a backing material. Suitable backing materials are described supra.

In one aspect of the present invention, applying the polymer binder precursor, the dye, and the abrasive grains over the backing material can include applying a make coat over the backing. In some instances, such a make coat can include at least a portion of the IR absorbing dye and/or at least a portion of the polymer binder precursor. The concentration of dye in such a make coat can vary, however, in some cases the concentration of dye in the make coat is about 0.0000001 weight percent (wt %) to about 10 wt % such as, for example, about 0.0001 wt % to about 10 wt %, about 0.0001 wt % to about 2 wt %, about 0.0001 wt % to about 1 wt %, about 0.0001 wt % to about 0.1 wt %, about 0.0001 wt % to about 0.01 wt %, or about 0.0001 wt % to about 0.001 wt % (all wt % based on weight of the make coat). The method can also include the additional step of applying the abrasive grains to the make coat. In one embodiment, the make coat is at least partially cured, e.g., using infrared radiation.

In one embodiment, applying the polymer binder precursor, the dye, and the abrasive grains to the backing material includes applying a size coat. In some instances, such a size coat can include at least a portion of the IR absorbing dye and/or at least a portion of the polymer binder precursor. The concentration of dye in such a size coat can vary, however, in some cases the concentration of dye in the size coat is about 0.0000001 weight percent (wt %) to about 10 wt % such as, for example, about 0.0001 wt % to about 10 wt %, about 0.0001 wt % to about 2 wt %, about 0.0001 wt % to about 1 wt %, about 0.0001 wt % to about 0.1 wt %, about 0.0001 wt % to about 0.01 wt %, or about 0.0001 wt % to about 0.001 wt %.

In some embodiments, the concentration of dye in the size coat is about 0.003 wt % to about 0.0015 wt % (all wt % based on weight of the size coat). In one embodiment, the size coat is at least partially cured, e.g., using infrared radiation.

The present invention also includes a method of at least partially curing an article that includes a polymer binder precursor, an infrared radiation absorbing dye, and abrasive grains using infrared radiation wherein a mixture of the polymer binder precursor, the infrared radiation absorbing dye, and the abrasive grains is applied over a backing material. In one embodiment, applying such a mixture over the backing material includes shaping the mixture into abrasive structures as further described supra.

In some embodiments, the abrasive article includes a backing material that is at least partially transparent to IR. Thus, in one embodiment, IR radiation can be applied to the backing of an article to affect curing on the opposite side of the backing. For example, IR radiation can be applied to one or both sides of an abrasive article to effect at least partial curing of the polymer binder precursor. A reflective surface can be used under a backing material so that IR passing through the backing is redirected up through the article. For example, in one embodiment, the article has a first surface and a second surface and the infrared radiation is directed toward the first surface of the article and a reflective surface is positioned near the second surface of the article.

The present invention also includes a method for manufacturing an abrasive product comprising: (a) applying a polymer binder precursor, an infrared radiation absorbing dye, and abrasive grains to a backing to form an uncured article; and (b) at least partially curing the article using infrared radiation.

The present invention also includes abrasive articles made as described herein. In addition, the present invention includes a method for abrading or grinding a workpiece, e.g., a metal, wood, plastic, painted, glass, or stone workpiece, using the abrasive articles described herein. For example, the present invention includes a method for abrading or grinding a workpiece using an abrasive article produced by curing an article which includes a polymer binder precursor, an infrared radiation absorbing dye, and abrasive grains using infrared radiation.

Infrared cured abrasive articles and methods for their manufacture are also described in U.S. Provisional Patent Application No. 60/788,902, entitled "Infrared Cured Abrasive Articles and Method of Manufacture," filed on Apr. 4, 2006, the entire contents of which is incorporated herein by reference.

EXEMPLIFICATION

The invention will now be further and specifically described by the following examples which are not intended to be limiting.

For each of the following examples, a heat lamp (Model No. CL-300D; Fostoria Industries, Inc.; Fostoria, Ohio) equipped with a 250 W BBA light bulb having a color temperature of 3400K (General Electric Lighting; Cleveland, Ohio) was used.

SDA 5688 infrared (IR) dye (H.W. Sands Corp.; Jupiter, Fla.), having a maximum absorption at a wavelength of 841 nanometers (nm), was used in the abrasive articles of Examples 1-6.

For Examples 1, 3-4, and 6, articles were prepared having abrasive grains and a make coat applied over a 5 mil (0.127 mm) polyester backing (PET film, TPF7005; Mitsubishi Polyester Film, Inc.; Greer, S.C.) that was 10 inches (25.4 cm) wide and 12 inches (30.48 cm) long. The abrasive grains used were 80 micron heat treated semi-friable aluminum oxide BFRPL, P180 grit (Treibacher Industrie, Inc.; Toronto, Canada) and the make coat was formed of ultraviolet (UV)-curable epoxy/acrylate resins. Specifically, a make coat having the composition shown in Table 1 was prepared and applied to the backing at a make coat weight of 1.2 lb/ream (0.55 kg/ream).

TABLE 1

| Ingredient | Description | Source | Weight Percentage (wt %) |
|---|---|---|---|
| UVR 6105 | 4-epoxy cyclohexyl methyl-3,4 epoxy cyclohexyl carboxylate | Dow Chemical Co.; Midland, MI | 39.24 |
| GRILONIT ® F713 | Polytetrahydrofuran diglycidylether | Ems-Chemie (North America), Inc.; Sumter, SC | 28 |
| EBECRYL ® 3700 | Acrylated ester of Bisphenol-A based epoxy | Cytec Surface Specialties, Inc.; Smyrna, GA | 26 |
| IRGACURE ® 184 | 1-Hydroxycyclohexyl phenyl ketone | Ciba Specialty Chemicals Corporation; Tarrytown, NY | 1.75 |
| CHIVACURE ® 1176 | Mixture of triarysulfonium hexafluoroantimonate salts | Chitec Technology Co., Ltd.; Taipei, Taiwan | 4.8 |
| BYK A-501 | Silicon-free Defoamers | Byk-Chemie USA, Inc.; Wallingford, CT | 0.02 |
| SILWET ® L 7600 | Polyalkyleneoxide modified polydimethylsiloxane | GE Advanced Materials; Wilton, CT | 0.2 |
| | Total | | 100 |

The abrasive grains were then applied onto the make coat at a grain weight of 8.5 lb/ream (3.9 kg/ream). Then, the make coat was cured at a line speed of 50 feet per min (15.2 meters/min) using UV radiation supplied by a Fusion F300S UV lamps (Fusion UV Systems, Inc.; Gaithersburg, Md.) containing 300 W D and 300 W H bulbs. The distance from the UV source to the make coat was about 2 inches (5.08 cm).

Example 1

The following example describes the production of abrasive articles wherein the concentration of infrared radiation absorbing dye was varied. Size coat formulations having the compositions indicated in Table 1 were prepared and applied over articles having a cured make coat (about 4.8 lb make coat/ream (2.2 kg/ream)) and abrasive grains, produced as described supra.

As shown in Table 2, the size coat formulations included resin (UVR-6105: 4-epoxy cyclohexyl methyl-3,4 epoxy cyclohexyl carboxylate; Dow Chemical Co.; Midland, Mich.); glycidylether (HELOXY® 67 (Heloxy is a trademark of Hexion Speciality Chemicals, Inc.): 1,4-Butanediol diglycidyl ether; Resolution Performance, Inc., Houston, Tex.); a silane (3-glycidoxypropyl)trimethoxysilane; Gelest, Inc.; Morrisville, Pa.); a cationic photoinitiator (CHIVACURE® 1176; Chitec Technology Co, Ltd.; Taipei, Taiwan); a radical photoinitiator (IRGACURE® 184; Ciba Specialty Chemicals Corporation; Tarrytown, N.Y.); acrylate monomers (SR-351: a trimethylol propane triacrylate; Atofina-Sartomer; Exton, Pa.); dipentaerythritol hexaacrylate (DPHA) (Nagase America Corp.; New York, N.Y.); and SDA5688 IR absorbing dye.

The size coat formulation also included nano-sized filler particles (NANOPOX® A 610: 40 wt % colloidal nano-silica filler in 3,4-epoxy cyclohexyl methyl-3,4-epoxy cyclohexyl carboxylate; Hanse Chemie USA, Inc.; Hilton Head, S.C.) and micron-sized filler particles, NP-30 (Asahi Glass Co, Ltd.; Tokyo, Japan) and ATH S-3 (Alcoa, Inc.; Pittsburgh, Pa.). NP-30 contained spherical silica particles (purity: >99.5% $SiO_2$) having an average particle size of about 3 microns. ATH S-3 contained non-spherical alumina anhydride particles (purity: >99.5%) having an average particle size of about 3 microns.

TABLE 2

| Component | Size Coat Formulation | | | |
|---|---|---|---|---|
| | A | B | C | D |
| UVR-6105 | 0.71 | 0.71 | 0.71 | 0.71 |
| HELOXY ® 67 | 6.50 | 6.50 | 6.50 | 6.50 |
| SR-351 | 2.91 | 2.91 | 2.91 | 2.91 |
| DPHA | 1.80 | 1.80 | 1.80 | 1.80 |
| (3-glycidoxypropyl)tri-methoxysilane | 1.17 | 1.17 | 1.17 | 1.17 |
| CHIVACURE ® 184 | 0.78 | 0.78 | 0.78 | 0.78 |
| NP-30 | 46.71 | 46.71 | 46.71 | 46.71 |
| ATH S-3 | 7.78 | 7.78 | 7.78 | 7.78 |
| NANOPOX ® A 610 | 27.75 | 27.75 | 27.75 | 27.75 |
| CHIVACURE ® 1176 | 3.89 | 3.89 | 3.89 | 3.89 |
| SDA 5688 | 0.00037 | 0.00072 | 0.00107 | 0.00144 |

Compositions by weight percent (wt %).

The resulting articles having the indicated size coatings were then UV cured using a 150 W D bulb and a 150 W H bulb at a distance of 2 inches (5.08 cm) from the UV source and at a line speed of 50 feet per minute (15.2 meters/min). The articles were then exposed to IR radiation from the heat lamp equipped with a 250 W BBA light bulb at a distance of 9 inches (22.9 cm) for 1 minute.

Example 2

This example describes a performance evaluation of abrasive articles produced as described in Example 1. A 1045 steel ring-shaped workpiece was abraded using an abrasive article and then average maximum surface height (Rz) and stock removal were measured.

The workpiece was preconditioned using a 100 micron abrasive film (Model No. Q151; Saint-Gobain Abrasives, Inc.; Worcester, Mass.) and then washed using a non-abrasive cleaner and air-dried. An initial measurement of the ring and ring surface was taken. The weight of the ring was measured and the surface quality was measured using a Surtronic 3+ surface finish measurement device (Taylor Hobson, Ltd; Leicester, England).

The workpiece was then abraded with the abrasive article. The workpiece was rotated about its central axis and also oscillated back and forth along its central axis. The pressure applied between the abrasive and workpiece was approximately 75 pounds per square inch (psi) (517 kPa). The cycle time was approximately 5 seconds at 210 RPM and the frequency of the oscillation along the central axis was 5 Hertz. After the workpiece was rotated in one direction for one 5 second cycle, the direction of rotation was reversed and the workpiece was abraded for another 5 second cycle. As the workpiece was abraded, mineral seal oil was applied as a coolant. Following abrading, the workpiece washed and analyzed.

Average maximum surface height (Rz) and stock removal were then determined by weighing the workpiece and using the Surtronic 3+ device. Rz was used to quantify the effect of binder formulation on workpiece surface uniformity. The stock removal was used to quantify the effect of binder formulation on the stock removal rate. Alternatively, stock removal could be indicated by differences in the diameter of the rings.

Table 3 summarizes the performance evaluation of the abrasive articles produced as described in Example 1.

TABLE 3

| | Size Coat Formulation | | | |
|---|---|---|---|---|
| | A | B | C | D |
| Rz (microns) | 1.98 | 1.30 | 1.21 | 1.39 |
| Stock Removal (% Relative to Formulation A) | 100 | 55 | 62 | 69 |

The experimental results indicate that the stock removal was influenced by IR dye concentration. Under the indicated experimental conditions, an IR dye concentration of 0.0037 wt % gave the best stock removal performance.

Example 3

The following example describes production of abrasive articles wherein the distance between the infrared radiation source and the abrasive article was varied. Three abrasive articles were prepared as described in Example 1 using Size Coat Formulation B. However, in this experiment, the distance between the heat lamp and the article was varied for each of the samples. Table 4 shows the distance between the IR source and the sample and also the Rz and stock removal of the resulting abrasive articles (determined as described in Example 2).

TABLE 4

| | Abrasive Article | | |
|---|---|---|---|
| | E | F | G |
| IR Source Distance (inches) ((cm)) | 6 (15.2) | 9 (22.9) | 12 (30.5) |

TABLE 4-continued

| | Abrasive Article | | |
|---|---|---|---|
| | E | F | G |
| Rz (microns) | 1.9 | 1.3 | 1.12 |
| Stock Removal (% Relative to Article E) | 100 | 51 | 42 |

The experimental results indicate that the stock removal was influenced by IR source distance. Under the indicated experimental conditions, an IR source distance of 6 inches gave the best stock removal performance.

Example 4

The following example describes production of abrasive articles wherein the time of exposure to IR radiation was varied. Three abrasive articles were prepared as described in Example 1 using Size Coat Formulation B. However, in this experiment, the time of exposure of the articles to IR radiation was varied for each of the samples.

Table 5 shows the amount of time that each article was exposed to the IR source. Table 5 also shows the Rz and stock removal of the resulting abrasive articles (determined as described in Example 2).

TABLE 5

| | Abrasive Article | | |
|---|---|---|---|
| | H | I | J |
| IR Exposure Time (minutes) | 3 | 1 | 0 |
| Rz (microns) | 2.02 | 1.30 | 1.01 |
| Stock Removal (% Relative to Article H) | 100 | 49 | 27 |

The experimental results indicate that the stock removal was influenced by IR exposure time. Under the indicated experimental conditions, an IR exposure time of 3 minutes gave the best stock removal performance.

Example 5

The following example describes an experiment to evaluate the curing time for make coat formulations containing an IR radiation absorbing dye.

Make coat formulations were prepared as described in Table 5. The binder formulations included phenolic resin PF 94-908 (Durez Corp.; Addison, Tex.); inorganic filler (Wollastenite 325; Nyco Minerals, Inc.; Willisboro, N.Y.); water; and SDA5688 IR radiation absorbing dye.

A 1 mil (1/1,000 of an inch) (0.0254 mm) film of each make coat was applied to a separate 10 inch (25.4 cm) by 12 inch (30.48 cm) 5 mil (0.127 mm) clear, Mylar film. The make coat was applied at 1.2 lb make coat/ream (0.55 kg/ream). Onto each make coat, 80 micron heat treated semi-friable aluminum oxide BFRPL, P180 grit (Treibacher Industrie, Inc.) was spread to evenly cover the make coat with grain at 8.5 lb grain/ream (3.9 kg/ream).

The resulting film was then placed under the heat lamp equipped with a 250 W BBA light bulb at a distance of 9 inches (22.9 cm). For each sample, the time was recorded at which the make coating was cured. A control sample was cured in a conventional oven (Model No. AB650; Grieve Corp.; Round Lake, Ill.) at 120° F. for 6 hours.

Table 6 shows the make coat composition and the curing time for each trial.

TABLE 6

| | Trial | | | |
|---|---|---|---|---|
| Component | K | L | M | Control |
| PF 94-908 (wt %) | 53.28 | 53.28 | 53.28 | 53.28 |
| Water (wt %) | 4.10 | 4.10 | 4.10 | 4.10 |
| Wollastenite 325 (wt %) | 42.62 | 42.62 | 42.62 | 42.62 |
| SDA 5688 (wt %) | 0.0014 | 0.0028 | 0.0042 | 0 |
| Curing time (hour) | 1.5 | 1 | 0.75 | 6 |

The experimental results indicate that abrasive articles manufactured using an IR absorbing dye can be cured considerably faster than abrasive articles manufactured using conventional techniques.

Example 6

The following example describes production of abrasive articles wherein the method of postcure was varied.

Two abrasive articles were prepared using Size Coat Formulation B as described in Example 1. As described in Example 1, the resulting articles having the indicated size coatings were then UV cured using a 150 W D bulb and a 150 W H bulb at a distance of 2 inches (5.08 cm). One abrasive article was then post-cured in a conventional thermal oven (Model No. AB650; Grieve Corp.) at 220° F. (104° C.) for 15 minutes. The other abrasive article was exposed to IR radiation from the heat lamp equipped with a 250 W BBA light bulb at a distance of 9 inches (22.9 cm) for 2.75 minutes.

Table 7 shows the postcure conditions for each article. Table 7 also shows the Rz and stock removal of the resulting abrasive articles (determined as described in Example 2).

TABLE 7

| | Abrasive Article | |
|---|---|---|
| | N | O |
| Post-cure method | Conventional oven | IR Radiation cure |
| Post-cure time (minutes) | 15 | 2.75 |
| Rz (microns) | 1.47 | 2.15 |
| Stock Removal (% Relative to Article O) | 20.4 | 100 |

Example 7

The following example describes experiments to determine the effect of the choice of resin system on coating temperature over time. Coating temperature over time can be used an indicator of curing time.

Three UV-curable resin systems, (1) an epoxy resin system, (2) an epoxy/acrylate resin system, and (3) an acrylate resin system, were used to investigate the effect of choice of resin systems. Tables 8-10 show the compositions of the three resin systems. (TERATHANE® 250: low molecular weight polytetra methylene ether glycol (Invista, Wichita, Kans.); OXT-212: 3-ethyl-3-((2-ethylhexyloxy)methyl)-oxetane (Toagosei America, OH); IRGACURE® 2022: liquid multifunctional photoinitiator blend, based on IRGACURE® 819 bisacylphosphie oxide photoinitiator (Ciba Specialty Chemicals Corporation; Tarrytown, N.Y.)).

TABLE 8

| Epoxy Resin System | |
|---|---|
| Component | Weight Percentage (wt %) |
| UVR 6105 | 75.28 |
| TERATHANE ® 250 | 9.41 |
| OXT-212 | 9.41 |
| CHIVACURE ® 1176 | 5.90 |
| Total | 100 |

TABLE 9

| Epoxy/Acrylate Resin System | |
|---|---|
| Component | Weight Percentage (wt %) |
| UVR 6105 | 50.46 |
| HELOXY ® 67 | 18.89 |
| SR-351 | 8.45 |
| DPHA | 5.22 |
| (3-glycidoxypropyl) trimethoxysilane | 3.39 |
| CHIVACURE ® 184 | 2.26 |
| CHIVACURE ® 1176 | 11.31 |
| Total | 100 |

TABLE 10

| Acrylate Resin System | |
|---|---|
| Component | Weight Percentage (wt %) |
| SR-351 | 60.57 |
| DPHA | 37.43 |
| IRGACURE ® 2022 | 2.00 |
| Total | 100 |

IR dyes having varying peak light absorbance were used and are listed in Table 11 along with selected properties of the dyes. The IR dyes are available from H.W. Sands Corp. (Jupiter, Fla.).

TABLE 11

| IR Dyes | | | |
|---|---|---|---|
| IR Dye | Absorbance Maximum (nanometers (nm)) | Extinction Coefficient ($M^{-1}cm^{-1}$) | Absorbance Maximum/ IR lamp peak output (%) |
| SDB5700 | 681 | 197000 | 80 |
| SDA9530 | 711 | 111000 | 84 |
| SDA7590 | 759 | 255000 | 89 |
| SDA9393 | 798 | 275000 | 94 |
| SDA5688 | 842 | 280000 | 99 |
| SDA5575 | 892 | 225000 | 105 |
| SDA5893 | 922 | 15900 | 108 |
| SDA1981 | 977 | 49200 | 115 |
| SDA4428 | 1014 | 180000 | 119 |

Coating formulations were prepared by mixing the resin systems of Tables 8-10 with various dyes of Table 11. The dye concentration in each coating formulation was 0.004 wt %. The coating formulations were coated (5 mil (0.127 mm) drawdown) on 5 mil (0.127 mm) Mylar film. Each coated film was fully cured via UV light exposure using a 150 W D bulb and a 150 W H bulb at a distance of 2 inches (5.08 cm) from the UV source and at a line speed of 50 feet per minute (15.2 meters/min). The coated films were then cut into small pieces and placed below a heat lamp equipped with a 250 W BBA light bulb at a distance of 9 inches (22.9 cm). The 250 W BBA light bulb had a peak IR radiant emittance at a wavelength about 850 nanometers (nm). Starting temperature of the coated film ($T_i$) as well as coated film temperature under IR lamp (T) were measured and recorded for samples exposed to the IR lamp in 10 second increments. Temperature was measured using a thermocouple placed at the surface of the coated film. Tables 12-20 show the change in temperature ($T-T_i$) for each of the coated films.

TABLE 12

| Coated Film with SDA5688 (Dye Absorbance Max: 842 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (1) Epoxy | 9.8 (5.4) | 17.4 (9.7) | 31.3 (17.4) | 37.2 (20.7) | 48 (26.7) | 55.9 (31.1) |
| (2) Epoxy/Acrylate | 9 (5) | 15.3 (8.5) | 33.5 (18.5) | 37.4 (20.8) | 49.5 (27.5) | 53.8 (29.9) |
| (3) Acrylate | 7 (3.9) | 10.7 (5.9) | 26.6 (14.8) | 33.8 (18.8) | 39.4 (21.9) | 49.1 (27.3) |

TABLE 13

| Coated Film with SDB5700 (Dye Absorbance Max: 681 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (1) Epoxy | 13.7 (7.6) | 23.6 (13.1) | 32.1 (17.8) | 41.9 (23.3) | 53.1 (29.5) | 58.8 (32.7) |
| (2) Epoxy/ Acrylate | 18.2 (10.1) | 25.9 (14.4) | 36.3 (20.2) | 50 (27.8) | 54.6 (30.3) | 61.5 (34.2) |
| (3) Acrylate | 10.5 (5.8) | 18.8 (10.4) | 28.6 (15.9) | 32 (17.8) | 39.8 (22.1) | 50 (27.8) |

TABLE 14

| Coated Film with SDA9530 (Dye Absorbance Max: 711 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (1) Epoxy | 13.6 (7.6) | 24.2 (13.4) | 32.1 (17.8) | 36.3 (20.2) | 39.6 (22) | 48.1 (26.7) |
| (2) Epoxy/ Acrylate | 7.7 (4.3) | 19.5 (10.8) | 36.4 (20.2) | 39.6 (22) | 50.5 (28.1) | 60.3 (33.5) |
| (3) Acrylate | 10 (5.6) | 18.1 (10.1) | 25 (13.9) | 29.1 (16.2) | 37.6 (20.9) | 44.2 (24.6) |

TABLE 15

| Coated Film with SDA7590 (Dye Absorbance Max: 759 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (1) Epoxy | 12.6 (7) | 20.5 (11.4) | 34.6 (19.2) | 39.6 (22) | 46.9 (26.1) | 60.9 (33.8) |
| (2) Epoxy/ Acrylate | 17.5 (9.7) | 25.4 (14.1) | 32.7 (18.2) | 50 (27.8) | 56.8 (31.6) | 63.9 (35.5) |

TABLE 15-continued

| Coated Film with SDA7590 (Dye Absorbance Max: 759 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (3) Acrylate | 8.3 (4.6) | 13.7 (7.6) | 19.5 (10.8) | 28.7 (15.9) | 39.1 (21.7) | 57.8 (32.1) |

TABLE 16

| Coated Film with SDA9393 (Dye Absorbance Max: 798 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (1) Epoxy | 10.6 (5.9) | 19.5 (10.8) | 30.8 (17.1) | 40.2 (22.3) | 55.6 (30.9) | 60.6 (33.7) |
| (2) Epoxy/ Acrylate | 17.4 (9.7) | 25.6 (14.2) | 33.4 (18.6) | 44.9 (24.9) | 57.8 (32.1) | 64.5 (35.8) |
| (3) Acrylate | 13.4 (7.4) | 20.9 (11.6) | 28.8 (16) | 34.7 (19.3) | 42.8 (23.8) | 50.5 (28.1) |

TABLE 17

| Coated Film with SDA5575 (Dye Absorbance Max: 892 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (1) Epoxy | 11.7 (6.5) | 17.7 (9.8) | 31.1 (17.3) | 36.8 (20.4) | 41 (22.8) | 48.4 (26.9) |
| (2) Epoxy/ Acrylate | 13.3 (7.4) | 26 (14.4) | 33.4 (18.6) | 39.7 (22.1) | 55.6 (30.9) | 59.8 (33.2) |
| (3) Acrylate | 12.3 (6.8) | 21.4 (11.9) | 29.7 (16.5) | 37 (20.6) | 44.6 (24.8) | 53.7 (29.8) |

TABLE 18

| Coated Film with SDA5893 (Dye Absorbance Max: 922 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (1) Epoxy | 7.4 (4.1) | 18.3 (10.2) | 28.9 (16.1) | 34.9 (19.4) | 51.9 (28.8) | 59.2 (32.9) |
| (2) Epoxy/ Acrylate | 13.4 (7.4) | 22.5 (12.5) | 35.3 (19.6) | 42.8 (23.8) | 58.3 (32.4) | 64.6 (35.9) |
| (3) Acrylate | 13.6 (7.6) | 18.5 (10.3) | 26 (14.4) | 38.1 (21.2) | 43 (23.9) | 51 (28.3) |

TABLE 19

| Coated Film with SDA1981 (Dye Absorbance Max: 977 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (1) Epoxy | 14.9 (8.3) | 24.3 (13.5) | 43.3 (24.1) | 50.7 (28.2) | 54.4 (32.2) | 62.2 (34.6) |
| (2) Epoxy/ Acrylate | 19.2 (10.7) | 26.4 (14.7) | 36.9 (20.5) | 43.4 (24.1) | 54.1 (30.1) | 62.8 (34.9) |

TABLE 19-continued

| Coated Film with SDA1981 (Dye Absorbance Max: 977 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (3) Acrylate | 13.9 (7.7) | 19.6 (10.9) | 25.5 (14.2) | 33.8 (18.8) | 45.2 (25.1) | 52.2 (29) |

TABLE 20

| Coated Film with SDA4428 (Dye Absorbance Max: 1014 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (1) Epoxy | 8.1 (4.5) | 18.1 (10.1) | 26.7 (14.8) | 38.2 (21.2) | 47.5 (26.4) | 53.8 (29.9) |
| (2) Epoxy/ Acrylate | 20.9 (11.6) | 27.4 (15.2) | 36.5 (20.3) | 47.6 (26.4) | 61.3 (34.1) | 65.6 (36.4) |
| (3) Acrylate | 13.8 (7.7) | 22.6 (12.6) | 30.2 (16.8) | 37.4 (20.8) | 44.4 (24.7) | 48.7 (27.1) |

These results show that change in temperature over time, and therefore curing time, is influenced by the choice of resin system. The coating containing the epoxy resin system and dye SDA5688, having an absorbance maximum (842 nm) well-matched to the IR lamp peak output (850 nm), showed the largest temperature increase over time among the resin systems. Using the same dye (SDA5688), the coating containing the epoxy/acrylate resin system had a greater temperature increase than the coating containing the acrylate resin system.

For the remaining dyes, the dyes' absorbance maxima did not match as closely with IR lamp peak output (850 nm) as did SDA5688. Among the coated films containing those dyes, the coatings containing the epoxy/acrylate resin systems generally demonstrated the largest temperature increase over time among the three resin systems. The coatings containing the epoxy resin system produced larger temperature increases than the coatings containing the acrylate resin system.

Example 8

The following example describes experiments to determine the effect of the choice of filler on coating temperature over time.

Four coating formulations based on the epoxy/acrylate resin system of Example 7 were investigated. Tables 21 and 22 list components of the four coating formulations. Each coating formulation also contained IR absorbing dye.

Coating formulation "(2) No Filler" had the same composition as coating formulation "(2) Epoxy/Acrylate" of Example 7.

Coating formulation "(2A) Nano-Filler" added NANOPOX® A 610 to the epoxy/acrylate formulation. NANOPOX® A 610 is a nanoparticle modified cycloaliphatic epoxy resin (hanse chemie USA, Inc., Hilton Head Island, S.C.). NANOPOX® A 610 contains about 60 wt % 4-epoxy cyclohexyl methyl-3,4 epoxy cyclohexyl carboxylate and about 40 wt % $SiO_2$ nano-filler with a size of less than 50 nm.

Coating formulation "(2B) White Fillers" added NP-30 and ATH S-3 to the epoxy/acrylate formulation.

Coating formulation "(2C) Dark Fillers" added 80 micron heat treated semi-friable aluminum oxide BFRPL, P180 grit (Treibacher Industrie, Inc.; Toronto, Canada) ("BFRPL P180") to the epoxy/acrylate formulation.

TABLE 21

Coating System Components

| Component | Coating System (2) No Filler | (2A) Nano-Filler | (2B) White Fillers | (2C) Dark Fillers |
|---|---|---|---|---|
| | Parts by Weight | | | |
| UVR-6105 | 22.30 | 0.91 | 0.91 | 0.91 |
| HELOXY ® 67 | 8.35 | 8.35 | 8.35 | 8.35 |
| SR-351 | 3.74 | 3.74 | 3.74 | 3.74 |
| DPHA | 2.31 | 2.31 | 2.31 | 2.31 |
| (3-glycidoxypropyl) trimethoxysilane | 1.5 | 1.5 | 1.5 | 1.5 |
| CHIVACURE ® 184 | 1 | 1 | 1 | 1 |
| NP-30 | — | — | 60 | — |
| ATH S-3 | — | — | 10 | — |
| BFRPL P180 | — | — | — | 70 |
| NANOPOX ® A 610 | — | 35.65 | 35.65 | 35.65 |
| CHIVACURE ® 1176 | 5 | 5 | 5 | 5 |

TABLE 22

Chemical Equivalents for Coating System Components

| Chemical Equivalent | Coating System (2) No Filler | (2A) Nano-Filler | (2B) White Fillers | (2C) Dark Fillers |
|---|---|---|---|---|
| | Parts by Weight | | | |
| UVR-6105 | 22.30 | 22.30 | 22.30 | 22.30 |
| HELOXY ® 67 | 8.35 | 8.35 | 8.35 | 8.35 |
| SR-351 | 3.74 | 3.74 | 3.74 | 3.74 |
| DPHA | 2.31 | 2.31 | 2.31 | 2.31 |
| (3-glycidoxypropyl) trimethoxysilane | 1.5 | 1.5 | 1.5 | 1.5 |
| CHIVACURE ® 184 | 1 | 1 | 1 | 1 |
| NP-30 | — | — | 60 | — |
| ATH S-3 | — | — | 10 | — |
| BFRPL P180 | — | — | — | 70 |
| Nano-silica | — | 14.26 | 14.26 | 14.26 |
| CHIVACURE ® 1176 | 5 | 5 | 5 | 5 |

Coating formulations were prepared by mixing the components of Table 21 with selected dyes from Table 11. The dye concentration in each coating formulation was 0.004 wt %. As in Example 7, the coating formulations were coated (5 mil (0.127 mm) drawdown) on 5 mil (0.127 mm) Mylar film. Each coated film was fully cured via UV light exposure using a 150 W D bulb and a 150 W H bulb at a distance of 2 inches (5.08 cm) from the UV source and at a line speed of 50 feet per minute (15.2 meters/min). The coated films were then cut into small pieces and placed below a heat lamp equipped with a 250 W BBA light bulb at a distance of 9 inches (22.9 cm). The 250 W BBA light bulb had a peak IR radiant emittance at a wavelength about 850 nanometers (nm). Starting temperature of the coated film ($T_i$) as well as coated film temperature under IR lamp (T) were measured and recorded for samples exposed to the IR lamp in 10 second increments. Temperature was measured using a thermocouple placed at the surface of the coated film. Tables 23-28 show the change in temperature ($T-T_i$) for each of the coated films.

TABLE 23

Coated Film with SDA5688 (Dye Absorbance Max: 842 nm)

| Coating Formulation | Time 10 s | 20 s | 30 s | 40 s | 50 s | 60 s |
|---|---|---|---|---|---|---|
| | $T - T_i$ (° F. (° C.)) | | | | | |
| (2) No Filler | 9 (5) | 15.3 (8.5) | 33.5 (18.6) | 37.4 (20.8) | 49.5 (27.5) | 53.8 (29.9) |
| (2A) Nano-filler | 8.2 (4.6) | 15.1 (8.4) | 32.1 (17.8) | 42.2 (23.4) | 48.5 (26.9) | 50.8 (28.2) |
| (2B) White Fillers | 3 (1.7) | 6.5 (3.6) | 12.5 (6.9) | 18.3 (10.2) | 28.1 (15.6) | 35.4 (19.7) |
| (2C) Dark Fillers | 12.4 (6.9) | 17.8 (9.9) | 22.6 (12.6) | 32.6 (18.1) | 37.8 (21) | 39.4 (21.9) |

TABLE 24

Coated Film with SDB5700 (Dye Absorbance Max: 681 nm)

| Coating Formulation | Time 10 s | 20 s | 30 s | 40 s | 50 s | 60 s |
|---|---|---|---|---|---|---|
| | $T - T_i$ (° F. (° C.)) | | | | | |
| (2) No Filler | 18.2 (10.1) | 25.9 (14.4) | 36.3 (20.2) | 50 (27.8) | 54.6 (30.3) | 61.5 (34.2) |
| (2A) Nano-filler | 13.7 (7.6) | 24 (13.3) | 42.6 (23.7) | 46.7 (25.9) | 54.7 (30.4) | 58.2 (32.3) |
| (2B) White Fillers | 11 (6.1) | 13.9 (7.7) | 20.1 (11.2) | 27.7 (15.4) | 30.8 (17.1) | 39 (21.7) |
| (2C) Dark Fillers | 12 (6.7) | 15.5 (8.6) | 23.2 (12.9) | 40.6 (22.6) | 43.4 (24.1) | 45.1 (25.1) |

TABLE 25

Coated Film with SDA9530 (Dye Absorbance Max: 711 nm)

| Coating Formulation | Time 10 s | 20 s | 30 s | 40 s | 50 s | 60 s |
|---|---|---|---|---|---|---|
| | $T - T_i$ (° F. (° C.)) | | | | | |
| (2) No Filler | 7.7 (4.3) | 19.5 (10.8) | 36.4 (20.2) | 39.6 (22) | 50.5 (28.1) | 60.3 (33.5) |
| (2A) Nano-filler | 12.4 (6.9) | 21.5 (11.9) | 29.1 (16.2) | 34 (18.9) | 46 (25.6) | 59.7 (33.2) |
| (2B) White Fillers | 10.6 (5.9) | 15.4 (8.6) | 20.1 (11.2) | 32.5 (18.1) | 34.8 (19.3) | 38 (21.1) |
| (2C) Dark Fillers | 11.3 (6.3) | 18.9 (10.5) | 23.1 (12.8) | 40.3 (22.4) | 45 (25) | 45.8 (25.4) |

TABLE 26

Coated Film with SDA9393 (Dye Absorbance Max: 798 nm)

| Coating Formulation | Time 10 s | 20 s | 30 s | 40 s | 50 s | 60 s |
|---|---|---|---|---|---|---|
| | $T - T_i$ (° F. (° C.)) | | | | | |
| (2) No Filler | 17.4 (9.7) | 25.6 (14.2) | 33.4 (18.6) | 44.9 (24.9) | 57.8 (32.1) | 64.5 (35.8) |
| (2A) Nano-filler | 19.8 (11) | 24 (13.3) | 46.8 (26) | 50.2 (27.9) | 58.8 (32.7) | 63.5 (35.3) |
| (2B) White Fillers | 8.1 (4.5) | 14.5 (8.1) | 22.6 (12.6) | 30.2 (16.8) | 36.2 (20.1) | 38.5 (21.4) |
| (2C) Dark Fillers | 4.9 (2.7) | 11.8 (6.6) | 20 (11.1) | 31.7 (17.6) | 40.1 (22.3) | 42.9 (23.8) |

TABLE 27

| Coated Film with SDA5575 (Dye Absorbance Max: 892 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (2) No Filler | 13.3 (7.4) | 26 (14.4) | 33.4 (18.6) | 39.7 (22.1) | 55.6 (30.9) | 59.8 (32.2) |
| (2A) Nano-filler | 15.5 (8.6) | 20.1 (11.2) | 34.8 (19.3) | 47.8 (26.6) | 54.2 (30.1) | 60.2 (33.4) |
| (2B) White Fillers | 10.4 (5.8) | 15.1 (8.4) | 18.9 (10.5) | 26.2 (14.6) | 32 (17.8) | 35.3 (19.6) |
| (2C) Dark Fillers | 13.3 (7.4) | 22.8 (12.7) | 25.3 (14.1) | 36 (20) | 45.2 (25.1) | 50.9 (28.3) |

TABLE 28

| Coated Film with SDA4428 (Dye Absorbance Max: 1014 nm) | | | | | | |
|---|---|---|---|---|---|---|
| | Time | | | | | |
| Coating Formulation | 10 s | 20 s | 30 s | 40 s | 50 s | 60 s |
| | $T - T_i$ (° F. (° C.)) | | | | | |
| (2) No Filler | 20.9 (11.6) | 27.4 (15.2) | 36.5 (20.3) | 47.6 (26.4) | 61.3 (34.1) | 65.6 (36.4) |
| (2A) Nano-filler | 18.8 (10.4) | 23.2 (12.9) | 40.7 (22.6) | 48.6 (27) | 62.6 (34.8) | 63.1 (35.1) |
| (2B) White Fillers | 10.3 (5.7) | 16 (8.9) | 21.8 (12.1) | 29.9 (16.6) | 33.1 (18.4) | 38.4 (21.3) |
| (2C) Dark Fillers | 11.1 (6.2) | 16.1 (8.9) | 22.2 (12.3) | 35.4 (19.7) | 43.7 (24.3) | 47.6 (26.4) |

These results show that change in temperature over time, and therefore curing time, is influenced by the presence of fillers. Over the one minute IR exposure, nano-fillers had the least effect on change in temperature over time. Both the white and dark fillers decreased the change in temperature over time, with the white fillers having a more pronounced decrease in change in temperature over time.

Example 9

The following example describes experiments to determine the effect of the choice of backing material on coating temperature over time.

Coating formulations having the same composition as coating formulation "(2) Epoxy/Acrylate" of Example 7 was applied to two different backing materials, (1) 5 mil (0.127 mm) Mylar film and (2) 15 mil (0.381 mm) brown cotton (Saint-Gobain Abrasives, Inc.; Watervilet, N.Y.).

As described in Example 7, Coating formulations were prepared by mixing the components of Table 9 with selected dyes from Table 11. The dye concentration in the coating formulation was 0.004 wt %. The coating formulations were coated (5 mil (0.127 mm) drawdown) on each of the backing materials. The resulting coated films were fully cured via UV light exposure using a 150 W D bulb and a 150 W H bulb at a distance of 2 inches (5.08 cm) from the UV source and at a line speed of 50 feet per minute (15.2 meters/min). The coated films were then cut into small pieces and placed below a heat lamp equipped with a 250 W BBA light bulb at a distance of 9 inches (22.9 cm). The 250 W BBA light bulb had a peak IR radiant emittance at a wavelength about 850 nanometers (nm). Starting temperature of the coated film ($T_i$) as well as coated film temperature under IR lamp (T) were measured and recorded for samples exposed to the IR lamp in 10 second increments. Temperature was measured using a thermocouple placed at the surface of the coated film. Tables 29-34 show the change in temperature ($T-T_i$) for each of the coated films.

TABLE 29

| Coated Film with SDA5688 (Dye Absorbance Max: 842 nm) | | | | | | |
|---|---|---|---|---|---|---|
| | Time | | | | | |
| Backing Material | 10 s | 20 s | 30 s | 40 s | 50 s | 60 s |
| | $T - T_i$ (° F. (° C.)) | | | | | |
| Mylar Film | 9 (5) | 15.3 (8.5) | 33.5 (18.6) | 37.4 (20.8) | 49.5 (27.5) | 53.8 (29.9) |
| Brown Cotton | 17.9 (9.9) | 29.7 (16.5) | 38.3 (21.3) | 40 (22.2) | 60.6 (33.7) | 68.9 (38.3) |

TABLE 30

| Coated Film with SDB5700 (Dye Absorbance Max: 681 nm) | | | | | | |
|---|---|---|---|---|---|---|
| | Time | | | | | |
| Backing Material | 10 s | 20 s | 30 s | 40 s | 50 s | 60 s |
| | $T - T_i$ (° F. (° C.)) | | | | | |
| Mylar Film | 18.2 (10.1) | 25.9 (14.4) | 36.3 (20.2) | 50 (27.8) | 54.6 (30.3) | 61.5 (34.2) |
| Brown Cotton | 24.7 (13.7) | 36.5 (20.3) | 43.3 (24.1) | 46.4 (25.8) | 56.4 (31.3) | 65.9 (36.6) |

TABLE 31

| Coated Film with SDA9530 (Dye Absorbance Max: 711 nm) | | | | | | |
|---|---|---|---|---|---|---|
| | Time | | | | | |
| Backing Material | 10 s | 20 s | 30 s | 40 s | 50 s | 60 s |
| | $T - T_i$ (° F. (° C.)) | | | | | |
| Mylar Film | 7.7 (4.3) | 19.5 (10.8) | 36.4 (20.2) | 39.6 (22) | 50.5 (28.1) | 60.3 (33.5) |
| Brown Cotton | 23.1 (12.8) | 34.9 (19.4) | 47.4 (26.3) | 53.6 (29.8) | 62.6 (34.8) | 71.2 (39.6) |

TABLE 32

| Coated Film with SDA9393 (Dye Absorbance Max: 798 nm) | | | | | | |
|---|---|---|---|---|---|---|
| | Time | | | | | |
| Backing Material | 10 s | 20 s | 30 s | 40 s | 50 s | 60 s |
| | $T - T_i$ (° F. (° C.)) | | | | | |
| Mylar Film | 17.4 (9.7) | 25.6 (14.2) | 33.4 (18.6) | 44.9 (24.9) | 57.8 (32.1) | 64.5 (35.8) |
| Brown Cotton | 26.1 (14.5) | 40.3 (22.4) | 44.9 (24.9) | 50 (27.8) | 66 (36.7) | 70.7 (39.3) |

TABLE 33

| Coated Film with SDA5575 (Dye Absorbance Max: 892 nm) | | | | | | |
|---|---|---|---|---|---|---|
| | Time | | | | | |
| Backing Material | 10 s | 20 s | 30 s | 40 s | 50 s | 60 s |
| | $T - T_i$ (° F. (° C.)) | | | | | |
| Mylar Film | 13.3 (7.4) | 26 (14.4) | 33.4 (18.6) | 39.7 (22.1) | 55.6 (30.9) | 59.8 (33.2) |

TABLE 33-continued

| Coated Film with SDA5575 (Dye Absorbance Max: 892 nm) | | | | | | |
|---|---|---|---|---|---|---|
| | Time | | | | | |
| Backing Material | 10 s | 20 s | 30 s | 40 s | 50 s | 60 s |
| | $T - T_i$ (° F. (° C.)) | | | | | |
| Brown Cotton | 26.7 (14.8) | 38.9 (21.6) | 49.8 (27.7) | 56.8 (31.6) | 61.4 (34.1) | 65.3 (36.3) |

TABLE 34

| Coated Film with SDA4428 (Dye Absorbance Max: 1014 nm) | | | | | | |
|---|---|---|---|---|---|---|
| | Time | | | | | |
| Backing Material | 10 s | 20 s | 30 s | 40 s | 50 s | 60 s |
| | $T-T_i$ (° F. (° C.)) | | | | | |
| Mylar Film | 20.9 (11.6) | 27.4 (15.2) | 36.5 (20.3) | 47.6 (26.4) | 61.3 (34.1) | 65.6 (36.4) |
| Brown Cotton | 24.6 (13.7) | 38.2 (21.2) | 49.4 (27.4) | 53.6 (29.8) | 58.9 (32.7) | 65.7 (36.5) |

These results show that change in temperature over time, and therefore curing time, is influenced by the choice of backing. Over the one minute IR exposure, the samples containing brown cotton backing material showed an increased change in temperature. The results show that articles containing dark colored backing materials, such as brown cotton, generally have quicker temperature increases as compared to articles containing colorless or clear backing materials such as the Mylar film.

While this invention has been particularly shown and described with references to example embodiments thereof, it will be understood by those skilled in the art that various changes in form and details may be made therein without departing from the scope of the invention encompassed by the appended claims.

What is claimed is:

1. An abrasive article comprising:

a backing;

abrasive grains;

a polymer binder; and about 0.0000001 weight percent to about 0.01 weight percent based on the weight of the polymer binder of an infrared radiation absorbing dye, wherein the polymer binder, the infrared radiation absorbing dye, and the abrasive grains are disposed over the backing, and wherein the infrared radiation absorbing dye is selected from the group consisting of cyanine dyes, croconium dyes, metal phthalocyanine dyes, metalated azo dyes, metalated indoaniline dyes, amminium dyes, metal complex dyes, and combinations thereof having a peak absorption intensity in the infrared radiation spectrum within a wavelength of about 0.7 to 1.3 microns and an absorption intensity at all wavelengths in the non-infrared spectrum of less than about fifty percent (50%) of the peak absorption intensity within the infrared spectrum.

2. The abrasive article of claim 1 wherein the backing is at least partially transparent to infrared radiation.

3. The abrasive article of claim 1 wherein the polymer binder includes at least one polymer selected from the group consisting of phenolic polymers, urethane polymers, epoxy polymers, acrylate polymers, epoxy/acrylate polymers, acrylated urethane polymers, acrylated epoxy polymers, urea-formaldehyde polymers, and combinations thereof.

4. The abrasive article of claim 1 wherein the polymer binder includes an epoxy/acrylate polymer.

5. The abrasive article of claim 1 wherein the abrasive article includes a make coat.

6. The abrasive article of claim 5 wherein the make coat includes at least a portion of the infrared radiation absorbing dye and at least a portion of the polymer binder.

7. The abrasive article of claim 1 wherein the abrasive article includes a size coat.

8. The abrasive article of claim 7 wherein the size coat includes at least a portion of the infrared radiation absorbing dye and at least a portion of the polymer binder.

9. The abrasive article of claim 1 wherein the polymer binder has been at least partially cured using infrared radiation having a wavelength of about 0.7 to 1.3 microns.

10. The abrasive article of claim 1 wherein the absorption intensity of the infrared radiation absorbing dye at all wavelengths in the non-infrared spectrum is less than one third of the peak absorption intensity within the infrared spectrum.

11. The abrasive article of claim 1 wherein the abrasive article is a coated abrasive.

12. The abrasive article of claim 1 wherein the abrasive article is a structured abrasive.

13. The abrasive article of claim 1 wherein the abrasive article is a bonded abrasive.

14. A method of abrading a work surface comprising contacting the work surface with the abrasive article of claim 1 such that a portion of the work surface is removed.

15. The article of claim 1 further comprising a second, different infrared radiation absorbing dye having a peak absorption within the infrared spectrum, wherein all peak absorptions of the second infrared radiation absorbing dye in the non-infrared radiation spectrum are less than about seventy-five percent (75%) of the peak absorption within the infrared spectrum.

16. The article of claim 15 wherein the concentration of the infrared radiation-absorbing dye and/or the second infrared radiation-absorbing dye is uniform throughout the polymer binder precursor.

17. The article of claim 15 wherein the infrared radiation-absorbing dye and/or the second infrared radiation-absorbing dye is concentrated in a particular region of the article.

18. The article of claim 1 wherein the concentration of the infrared radiation absorbing dye is uniform throughout the polymer binder.

19. The article of claim 1 wherein the infrared radiation absorbing dye is concentrated in particular regions of the article.

20. The abrasive article of claim 1, wherein all peak absorptions of the infrared radiation absorbing dye in the non-infrared radiation spectrum are less than about 10% of the peak absorption intensity within the infraredspectrum.

21. An abrasive article formed by the method of:

disposing a polymer binder precursor, an infrared radiation absorbing dye, and abrasive grains on a backing to form an article; and at least partially curing the article using infrared radiation having a wavelength of about 0.7 to 1.3 microns to form an abrasive article, wherein the concentration of the infrared radiation absorbing dye is about 0.0000001 weight percent to about 0.01 weight percent based on the weight of the polymer binder, wherein the infrared radiation absorbing dye is selected from the group consisting of cyanine dyes, croconium dyes, metal phthalocyanine dyes, metalated azo dyes, metalated indoaniline dyes, amminium dyes, metal complex dyes, and combinations thereof, having a peak absorption intensity within the infrared radiation spectrum within a wavelength of about 0.7 to 1.3 microns and an absorption intensity at all wavelengths in the non-infrared radiation spectrum of less than about fifty percent (50%) of the peak absorption intensity within the infrared radiation spectrum.

* * * * *